US005608636A

United States Patent [19]

Guenther

[11] Patent Number: 5,608,636

[45] Date of Patent: Mar. 4, 1997

[54] METHOD FOR CONTROLLING THE COLUMN-BY-COLUMN PRINTING OF A FRANKING IMAGE IN A POSTAGE METER MACHINE

[75] Inventor: Stephen Guenther, Berlin, Germany

[73] Assignee: Francotyp-Postalia AG & Co., Birkenwerder, Germany

[21] Appl. No.: 263,378

[22] Filed: Jun. 21, 1994

[30] Foreign Application Priority Data

Jun. 21, 1993 [EP] European Pat. Off. ..... 93109899

[51] Int. Cl.[6] ..... G07B 17/00

[52] U.S. Cl. ..... 364/464.18; 101/71; 395/114

[58] Field of Search ..... 101/71; 364/464.02, 364/464.03; 395/114

[56] References Cited

U.S. PATENT DOCUMENTS

| | | | |
|---|---|---|---|
| 3,869,986 | 3/1975 | Hubbard | 101/91 |
| 4,168,533 | 9/1979 | Schwartz | 364/464.02 |
| 4,580,144 | 4/1986 | Calvi | 101/93.07 X |
| 4,831,554 | 5/1989 | Storace et al. | 364/464.02 X |
| 4,858,138 | 8/1989 | Talmadge | 364/464.02 |
| 4,872,119 | 10/1989 | Kajimoto | 364/464.03 |
| 5,038,153 | 8/1991 | Liechti et al. | 346/75 X |
| 5,233,657 | 8/1993 | Günther | 380/23 |
| 5,283,744 | 2/1994 | Abumehdi et al. | 364/464.02 |
| 5,394,795 | 3/1995 | Ferreol-Ragotin | 101/91 |
| 5,408,416 | 4/1995 | Gilham | 364/464.02 |

FOREIGN PATENT DOCUMENTS

| | | |
|---|---|---|
| 0261978 | 3/1988 | European Pat. Off. . |
| 352498 | 1/1990 | European Pat. Off. . |
| 2646943 | 5/1989 | France . |
| 3712100 | 10/1987 | Germany . |
| 4034292 | 4/1992 | Germany . |

*Primary Examiner*—Edward R. Cosimano
*Attorney, Agent, or Firm*—Hill, Steadman & Simpson

[57] ABSTRACT

In a method for controlling the column-by-column printing of a franking image in a postage meter machine, the image data are kept ready in encoded form and are converted into binary signals before a printing event for driving printer elements. Invariable and variable image contents are converted into binary data separately from one another, and the converted variable and invariable image data are combined during the printing of the franking image.

18 Claims, 5 Drawing Sheets

METHOD FOR CONTROLLING THE COLUMN-BY-COLUMN PRINTING OF A FRANKING IMAGE IN A POSTAGE METER MACHINE

BACKGROUND OF THE INVENTION

1. Field of the Invention

The present invention is directed to a method for controlling the column-by-column printing of a franking image or impression in a postage meter machine, whereby the image data are kept ready in encoded form and are converted into binary signals for driving printer elements before a printing event.

2. Description of the Prior Art

In this known method of the type described above, a franking image in the form of coded image data is stored in a memory for every possible postage value. When printing the franking image on an envelope, the envelope is passed under a printer head whose printer elements are arranged in a column transversely relative to the conveying direction. A franking image having a suitable postage value is selected and printed dependent on the weight of the letter or on the size of the envelope. Before or during the column-by-column printing, the coded image data are decoded, converted into binary data and binary signals for driving the printer elements are produced therefrom. When many different postage values occur or when the franking image is to contain other variable image parts such as, for example, a date, then a memory having a large storage capacity, or a large number of electronic memory modules must be provided for storing the coded image data. This requires space to be reserved for the memory or modules in a postage meter machine, and thus increases the technical outlay and costs.

Another disadvantage is that the conversion of the coded image information for an entire franking image is relatively time-consuming. The time required for coding lengthens the time between two impressions in a postage meter machine, so that the throughput of letters per time unit is limited.

U.S. Pat. No. 4,580,144 discloses a method wherein the franking image is composed of two sub-images. A constant image part (one sub-image) is printed on an envelope by a first printing station. The postage value (the other sub-image), that can vary dependent on the letter, is printed by a second printing station. The image data for the variable image part are in encoded form and are converted into binary signals at the printing event for driving printer elements of a thermo-transfer printing head. The printing speed for the overall impression can be increased by the division of the franking image to be printed into two partial images. Since two printer heads are utilized in this known solution, however, the technological outlay is high.

German OS 40 34 292 discloses a printing method wherein a permanently prescribed part of the franking image is stored in the memory in the postage meter machine, whereas another part is kept ready in a data processing system arranged at a remote from the postage meter machine. Data of the permanently prescribed part are transmitted from the data processing system to the postage meter machine and are combined at the postage meter machine before the printing. The data of the permanently prescribed part of the franking image are stored in a non-volatile memory.

Further, German OS 37 12 100 discloses a postage meter machine message printing system wherein the postage meter machine has a memory for advertising messages. These advertising messages can be modified, for which purpose printing data are transmitted to the memory from a remote station.

Further, European Application 0 352 498 discloses a postage meter machine having a first memory that stores fixed data of a print format that is repeated at every franking. Variable data are stored in a second memory. The data of the two memories are superimposed on one another for printing.

SUMMARY OF THE INVENTION

An object of the invention is to specify a method for controlling the column-by-column printing of a franking image in a postage meter machine, whereby a plurality of different franking images can be produced and a high throughput of letters can be achieved given low technical outlay.

In a method of the type initially described, this object is achieved by converting invariable image contents and variable image contents separately from one another, and then combining the converted variable and invariable image data during (i.e., not before) the printing of the franking image.

The invention is based on the observation that a separate conversion of the invariable image contents and of the variable image contents into binary signals makes it possible to divide the conversion event and to implement the sub-events at different times. For example, the invariable image contents, which are directed to image parts of the franking image that repeat over and over, can be converted at a time when no printing is carried out, for example during conveying of envelopes to the printing station. Time for the conversion can thus be saved during the printing event and this can be executed faster. The throughput of letters in the postage meter machine is thus enhanced. As a result of not combining the converted image data until the printing, moreover, the time between the definition of the variable image contents to be printed, which are dependent, for example, on the weight of a letter and the actual printing is minimized. The throughput of letters in the postage meter machine is thereby further increased. As a result of the invention, the variable and invariable image information are combined in time-optimum fashion, so that the franking of postal matter is accelerated overall.

As a result of the separate handling of invariable and variable image contents, the binary data thereof not being combined until during the printing of a franking image, a great number of different franking images can be produced by offering different sets having respective invariable and/or variable image data. Neither a large memory volume nor a complicated hardware technique are required for this purpose. The method can therefore be realized with low technical outlay.

In a preferred exemplary embodiment of the invention, the variable image contents for each printing column are separately converted between the printing of two printing columns, for example, during the conveying of the letter into the printing station for printing the franking image. These variable image contents, as is known, are directed to the variable image parts of the franking image, for example, to the value of the postage fee or to a date. Since the set of variable contents is generally smaller compared to the invariable image contents, only a short time is required for the conversion of the variable image contents into binary signals. The time required for the conversion of coded image contents into binary signals, which has a direct influence on the throughput of envelopes per time unit, is thus shortened.

The throughput performance of the postage meter machine is thereby improved further.

In another preferred embodiment, the variable image contents are converted into binary data before the printing of the franking image and are kept ready in a memory, and the binary signals are generated from the binary data. In this exemplary embodiment, the conversion occurs before the printing, i.e. the printing event can be executed in an even shorter time since no time has to be provided for the conversion during printing. The throughput performance of the postage meter machine is thus enhanced even further.

In another exemplary embodiment of the invention, the invariable, coded image contents are kept ready in a read-only memory. These image contents are read out from this read-only memory before the beginning of printing and/or decoded. The read-only memory generally contains the control program for the microprocessor under whose control the method of the invention is implemented. The read-only memory is generally arranged on a chip module and is replaced given a change of the operating program of the postage meter machine. The invariable image contents for permanently prescribed image parts of a franking image can also be modified in a simple way during this replacement. Since, further, the coded, invariable image contents can be directly taken from the read-only memory, intermediate storage of these image contents is not required. Memory space or electronics modules can thereby be eliminated.

In another embodiment of the invention, the invariable image contents are converted into binary data before the printing of a franking image, binary signals being generated from these binary data. This permits data that are already decoded to be accessed with respect to the constant image part when printing a franking image. The time expended for a data conversion during the printer operation can thus be eliminated. The flexibility of the postage meter machine is thereby improved and the throughput of envelopes per time unit is enhanced further.

In another exemplary embodiment, the coded image contents are provided with control characters that indicate whether the image contents are variable or invariable. The type of image contents, which are usually stored in a memory, can be recognized with reference to these control characters and the image contents can be differently treated upon read-out. The storing or intermediate storing of the image contents dependent on their type is also possible in different memories or memory areas with the assistance of the control characters. The control characters can be attached to every image contents packet (bit sequence), for example in the form of a control bit. The respective binary value characterizes the type of image contents.

In a preferred exemplary embodiment, the control characters have a value that is not contained in the character set of the coded image contents. As a result, the control character, for example a binary word having a word length of eight bits, can be arranged in the middle of a sequence of coded image contents and can be recognized as control characters during analysis in the course of the conversion of the image contents into binary data.

In a practical embodiment of the method of the invention, the invariable image contents are sequentially converted into binary data column-by-column and assigned an address, and are checked for control characters. Each address is allocated to a printer element. Given the appearance of a predetermined window control character, the associated address is intermediately stored as a window address. Before the printing of a line, the binary data of the invariable image contents are offered for the appertaining printer elements sequentially according to their address for printing in a printing program. A branch is made to a window program from the printing program when a window address is reached. The variable image contents are converted into binary data in this window program and are offered by address for the appertaining printer elements. A return to the printing program is made after the processing of the window program.

A minimal memory location is required in this embodiment of the invention for storing the coded image contents and the binary data, whereby the number of working steps is low and the program parts required have a simple, surveyable structure.

In another embodiment, a plurality of window programs are kept ready, their respective starting addresses being indirectly stored under the window address dependent on the control character. Although the memory requirements for a read-only memory wherein the window programs are stored are thereby increased, a fast branch can be made to these window programs, whose processing time influences the letter throughput in the postage meter machine, without having to identify program parameters and transmit them for these window programs.

In an exemplary embodiment of the invention, further, a plurality of sets of coded, variable image contents that are allocated to different bits of a control signal can be offered. It, therefore, becomes possible to offer a set with variable image contents dependent on the information contained in the control signal. As information bits, the control signal can contain a postage value to be printed, a date, a time of day, a serial number of the postage meter machine, a running print number and/or a variable image part of a company logo.

In another embodiment of the invention, a plurality of sets of coded, invariable image contents are kept ready which can be optionally accessed. It thus becomes possible to reset or modify the fixed image parts of the franking image that repeat over and over. For example, the company logo in the franking image can be modified in this way.

In a preferred exemplary embodiment of the invention, runlength coding is employed for coding the image contents. This type of coding is distinguished by a high data compression, so that memory can be saved. Moreover, the decoding of the image contents and the generating of binary data can ensue with little time expenditure and few method steps. The conversion time required for decoding is thus short.

FIGS. *3a–3d* are schematic illustrations for explaining the conversion of the invariable and variable image contents into binary data in accordance with the inventive method.

Figure 4:
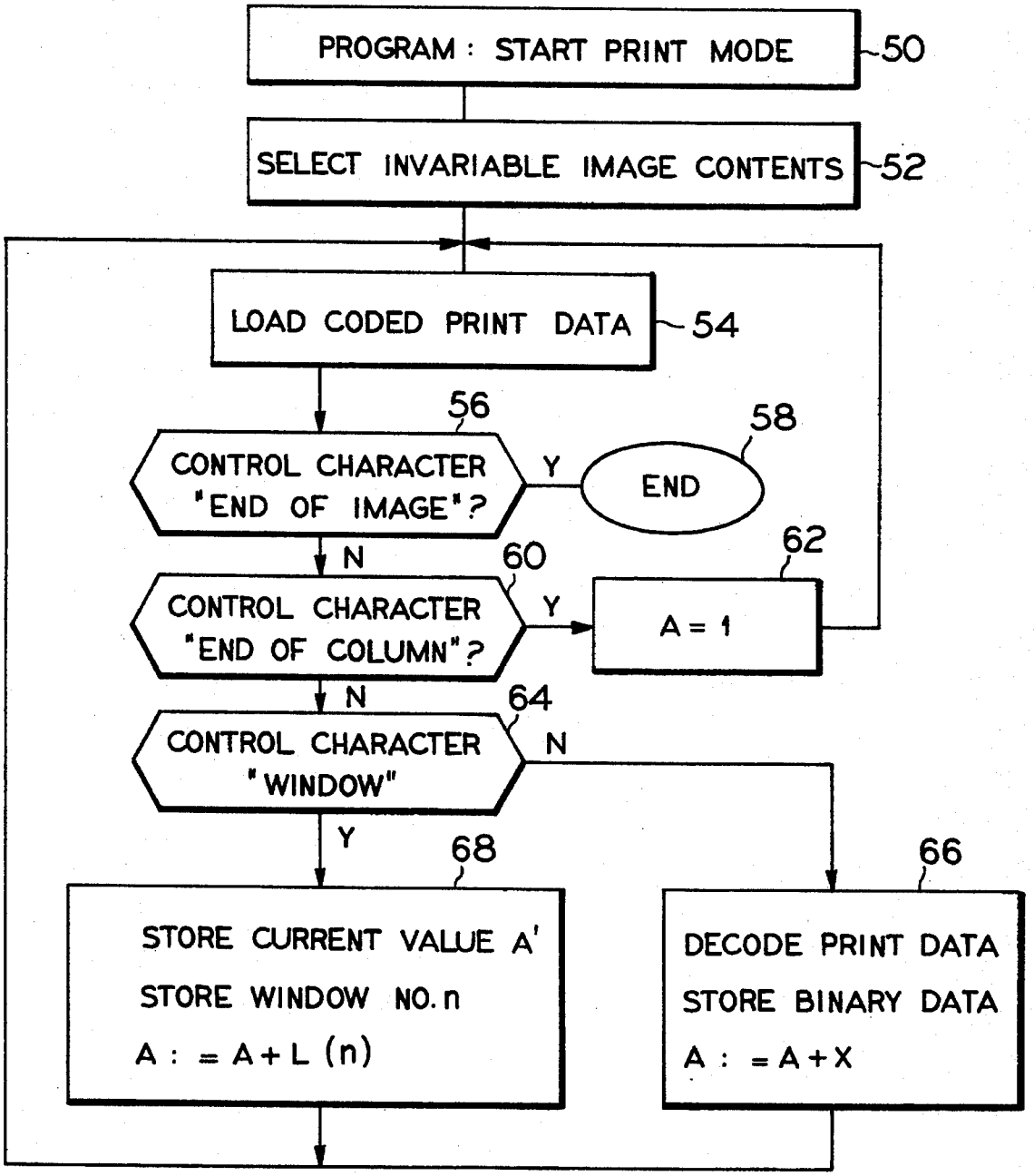

FIG. 4 is a flow chart of a program for the conversion of the invariable image contents into binary data and for generating the access to the variable image contents in accordance with the inventive method.

Figure 5:
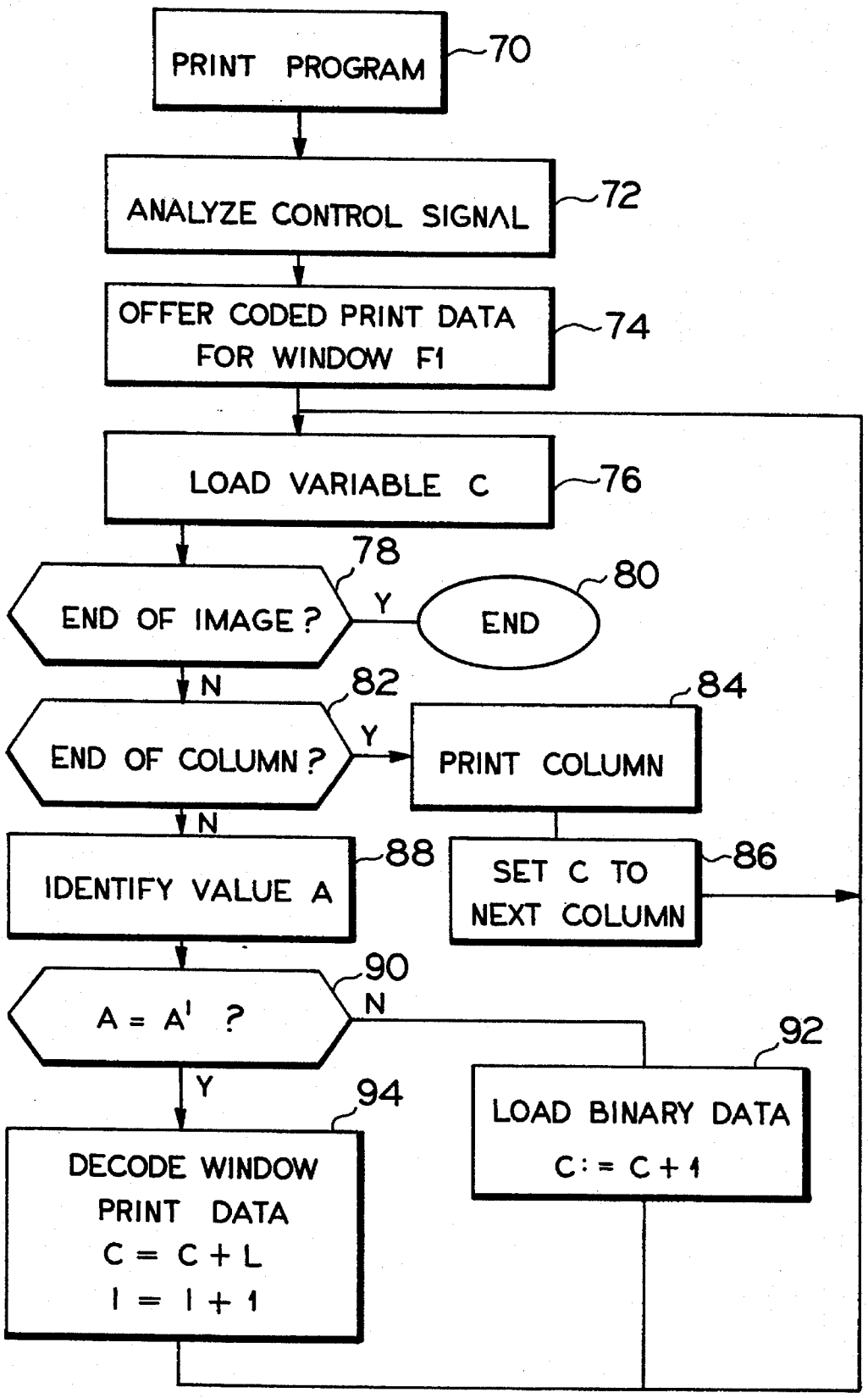

FIG. 5 is a flow chart of a program for generating binary data from the variable image contents during printing in accordance with the inventive method.

DESCRIPTION OF THE PREFERRED EMBODIMENTS

Figure 1:
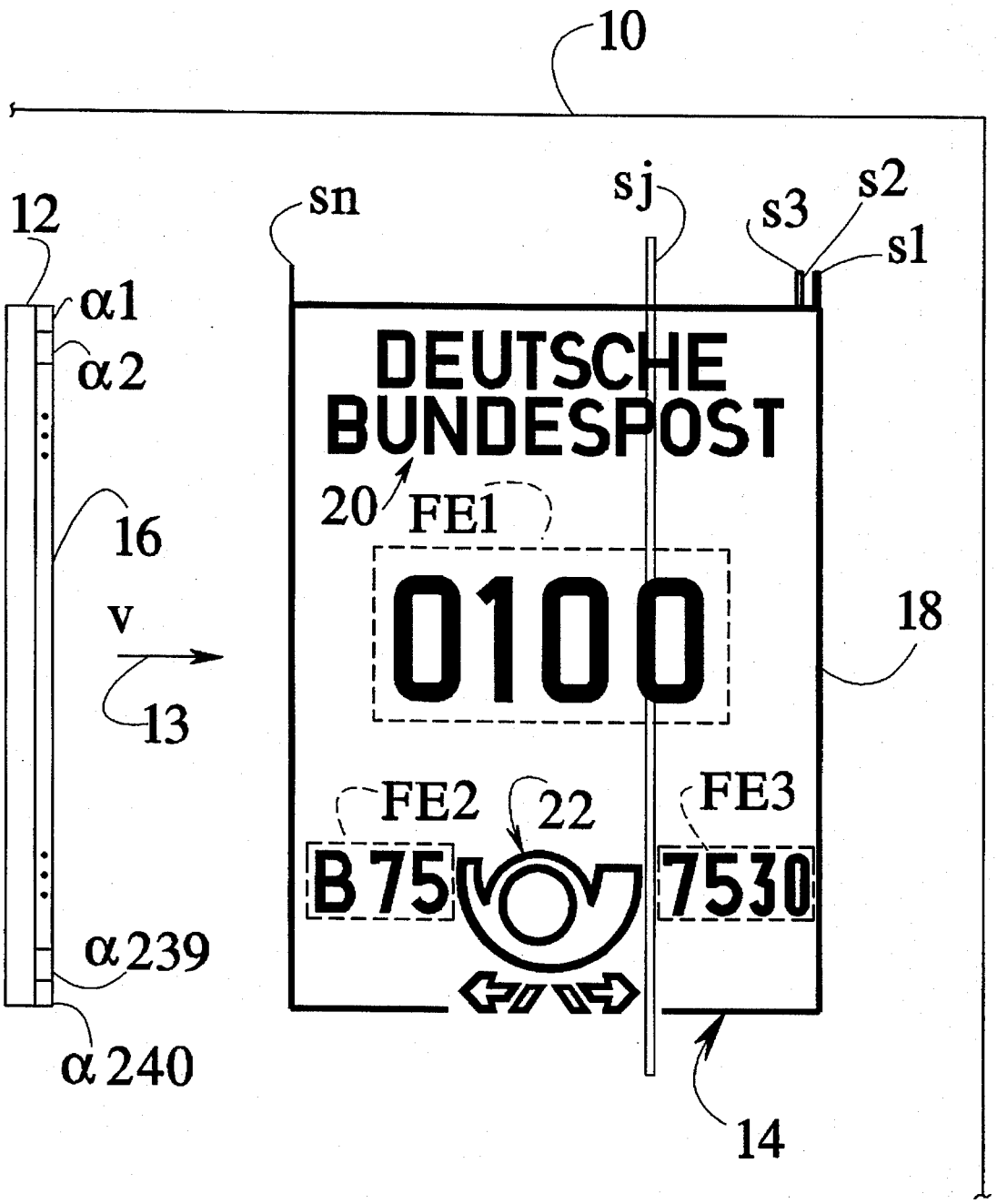
FIG. 1 shows an envelope conveyed under a printer head, this envelope being printed with a franking image.

In FIG. 1, an envelope 10 in a postage meter machine is conveyed under a thermo-transfer printer head 12 in the arrow direction 13 with constant velocity v, and is thereby printed with a franking image 14. The thermo-transfer printer head 12 has a thermal ledge 16 having 240 printer elements d1 through d240 arranged side-by-side. Each of these printer elements d1 through 240 has a filament resistance that can heat the respective printer element d1 through d240 to a temperature at which the ink of a thermal inking ribbon (not shown) conducted past under the thermal ledge 16 melts, and is thereby transferred onto the envelope 10. In this way, the envelope is printed column-by-column raster-like during a conveying motion. The columns s1, s2, s3, sj . . . sn are each printed approximately simultaneously by the printer elements d1 through d240, so that the print format of a column, for example of the column sj, proceeds on a straight line. It should be noted that the present invention, of course, can also be utilized for other printing methods, for example for the ETR printing method (electro-resistive thermo-transfer ribbon).

The franking image 14 has fixed, recurring image parts such as, for example, a frame 18, a text 20, and a picture element 22. Further fixed image parts can, for example, be company logos, addresses and advertising information; these, however, are not shown in FIG. 1 for clarity. The postage pattern 14 also contains variable image parts in windows FE1, FE2, FE3. The window FE1 contains the current postage value that is calculated by the postage meter machine dependent on the weight of the letter or on its size. The window FE2 or FE3 contains data specifically associated to the postage meter machine that are modified dependent on the operation of the postage meter machine.

Figure 2:
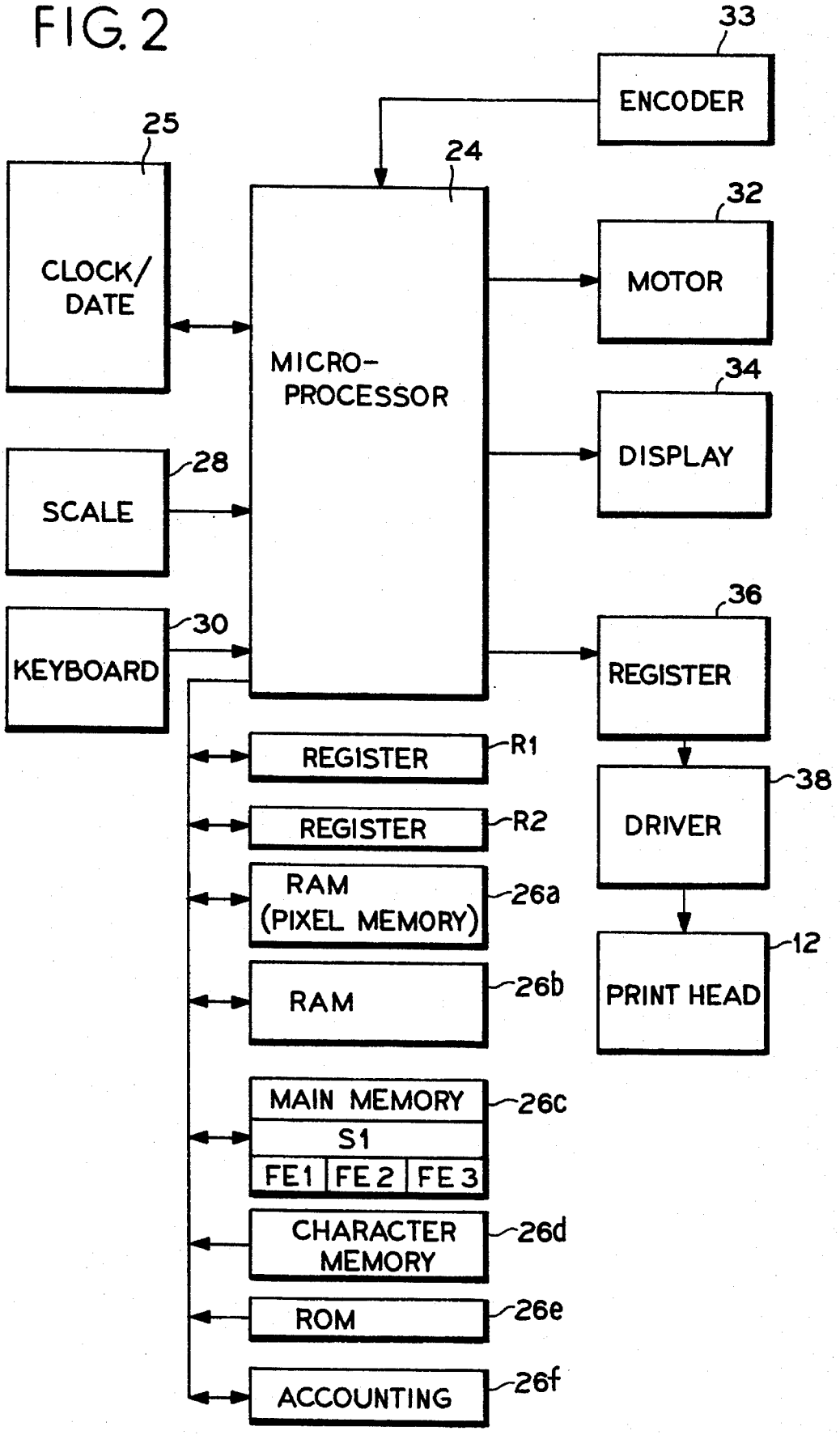
FIG. 2 is a block circuit diagram of hardware of a postage meter machine that is employed for the implementation of the method of the invention.

FIG. 2 shows a block circuit diagram of the hardware that can be employed for the implementation of the method of the invention. A microprocessor 24 is provided for the control of the method execution, this microprocessor 24 accessing memory elements R1, R2 and 26*a* through 26*f* described below. The microprocessor 24 communicates via an input/output module (not shown) with peripheral units, for example, with an electronic scale 28 that determines the weight of the envelope 10 with contents to be printed. Dependent on this weight, the microprocessor 24 defines the postage value to be printed. Time data are communicated to the microprocessor 24 via a clock module 25. An input keyboard 30 serves the purpose of manual control of the operation of the postage meter machine.

A conveying motor 32 is driven via the input/output module, this conveying motor 32 moving the envelope 10 beneath the printing ledge 16 of thermo-transfer printer head 12. A coding module 33 generates a signal corresponding to the motion of the motor, so that the exact position of the envelope 10 in the postage meter can be identified. A display 34 displays current operating conditions of the postage meter machine. This display 34 also serves the purpose of displaying the invariable and variable image contents, for example during editing. The input/output module also supplies binary data to a register 36 having a capacity of at least 50 bits, these binary data being converted by a driver 38 into binary signals with which the printer elements d1 through d50 of the thermo-transfer printer head 12 can be driven for printing a column.

The microprocessor 24 processes data that are stored in memory elements R1, R2 and 26*a* through 26*f*. Two registers R1 and R2 are volatile memories (RAM) and serve as the main memory. A volatile pixel memory 26*a* contains pixel data (binary data) in binary form in a column-by-column arrangement corresponding to the print, the binary signals for controlling the printer elements d1 through d50 being directly generated from these pixel data. Each pixel in the pixel memory 26*a* can be individually addressed.

Data are intermediately stored in a volatile memory 26*b* serving as a main memory for the microprocessor 24. The microprocessor 24 accesses a further memory 26*c* that likewise serves as a main memory. This memory 26*c* is a non-volatile read-write memory. It can be fashioned as a battery-buffered memory or as an EEPROM. Variable image contents, for example those of the windows FE1, FE2 and FE3, are stored therein, as are invariable image contents in an area S1.

Alphanumerical characters as pixel data are deposited in a character memory 26*d* in the form of binary data. The character memory 26*d* is a read-only memory (ROM).

A program memory 26*e* that is likewise a read-only memory (ROM) stores the program parts which are processed to implement the method of the invention. In one version of this embodiment, the program memory 26*e* additionally contains the invariable image contents for prescribed, fixed image parts that are stored under designations allocated to them.

Further, an accounting memory 26*f* is provided wherein security-relevant data of the postage meter machine are stored, for example the sum of used postage fees. The accounting memory 26*f* is a battery-buffered write-read memory.

For simplicity, the sequence of the method of the invention in the conversion of the coded image contents into binary data is schematically shown for a column comprising only 50 pixels in FIGS. 3*a*–3*d*. In this exemplary embodiment, the printer elements d1 through d50 of the thermal ledge 16 of the thermo-transfer printer head 12 are arranged in a row in FIG. 3*a*.

Figure 3A:
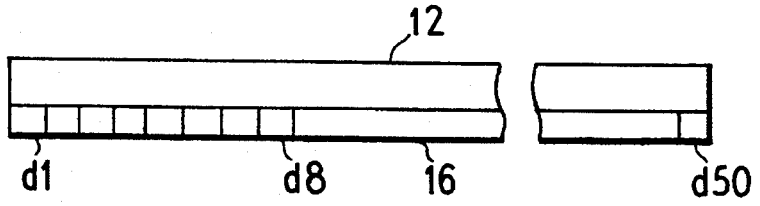
Figure 3B:
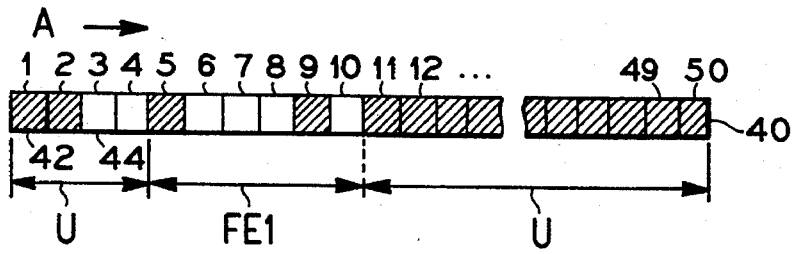

FIG. 3*b* shows a print pattern 40 of the column to be printed in the image of FIG. 3*a* under the thermo-transfer printer head 12. The print pattern is composed of the distribution of color (printed) printing dots, for example, the printing dot 42, and unprinted printing dots, for example the printing dot 44. The printing dots are each printed by a respective printer element, for example the printing dot 42 by the printer element d1. Each printing dot has specifically addressable binary information, i.e. one bit, in the pixel memory 26*a* allocated to it. The columns are to be printed sequentially, i.e., with ascending numbering, and thus the bits of a column are addressable with a run variable A having a value range 1–50. The momentary value of the run variable A is interpreted as the address for the printer elements d1 through d50.

It is assumed as an example that the first four as well as the last forty printing dots of the column are allocated to a recurring printing pattern that is referenced U. It is also assumed that the fifth through tenth printing dot (bits having run variable A=5 through A=10) form the variable print pattern of the window FE1.

Figure 3C:
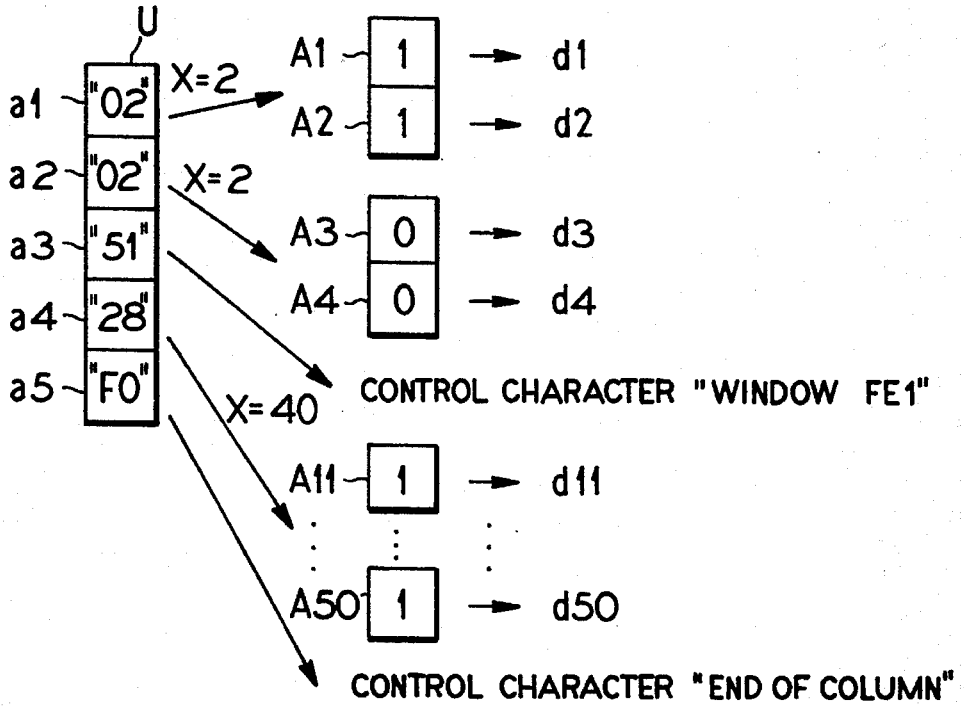

It is shown in FIG. 3*c* how the coded image information of the recurring print pattern U are converted into binary data and how the appearance of a window area is recognized. The invariable image contents of the print pattern U are stored as hexadecimal values in the main memory 26*c* after editing into runlength-coded form. The coded image information are stored byte-by-byte in a sequence with addresses A1 through A5 in the area S1 for the column. In runlength coding, it is indicated in alternation how many printing dots in the sequence are to be printed chromatically and how many are not to be printed. The particular "02" hexadecimally encoded under the address A1 denotes that the first two printing dots having the momentary addresses A=1 and A=2 (i.e., the run variable A has the value A=1 and A=2) are to be chromatically printed. The runlength X of the code (02) is thus two. In the conversion of the coded image information "02", two bits having respective addresses A=1 and A=2 are generated, these having the value 1, so that the printer elements d1 and d2 allocated to the bits having the respective addresses A=1 and A=2 produce chromatic printing dots. The analogous case applies to the invariable image contents loaded under the address A2, with the difference that, due to the alternating runlength coding, the following bits having the addresses A=3 and A=4 each contain the other binary value, i.e. 0. This means that no ink is transferred at the third and fourth printing dot, i.e. the printer elements d3 and d4 are not heated. A hexadecimal value "00" serves as a print control character for controlling the color change, i.e. it initiates the switching from heating of the printer element to non-heating and vice versa, whereby the runlength X is 0. It is possible to form arbitrarily long chains of printing dots having the same color information by means of this print control character. As a result thereof, thermo printing ledges having a number of printer elements that is larger than the available value range of a byte can be utilized.

As a consequence of the invariable image contents, the hexadecimal value "51" appears under the address A3. This value lies outside the defined value range of the runlength coding, that hexadecimally extends from "01" through "32" given 50 printer elements. Within the possible hexadecimal value range of a byte, which, as is known, extends from "00" to "FF", values that appear outside the value range of the runlength coding are interpreted as control characters. The first value "5" of the hexadecimal value "51" has the significance that a window begins within which variable image contents are to be offered. The second value "1" indicates the number of the window, i.e. the window FE1. A plurality of windows can be identified in this way. The method steps implemented upon appearance of a control character shall be set forth below.

The value "28" appearing under the address A4 in the sequence of invariable image contents is interpreted such that the binary places of the bits having run variable A=11 through A=50 each have the value 1, i.e. the printer elements d11 through d50 transfer ink onto the envelope 10.

The value "F0" appears under the address A5 and this is again interpreted as a control character. It has the significance that the end of the column has been reached. The run variable A is then reset to the initial value A1 at which the conversion of the invariable image contents into binary data can begin for the next column.

Figure 3D:
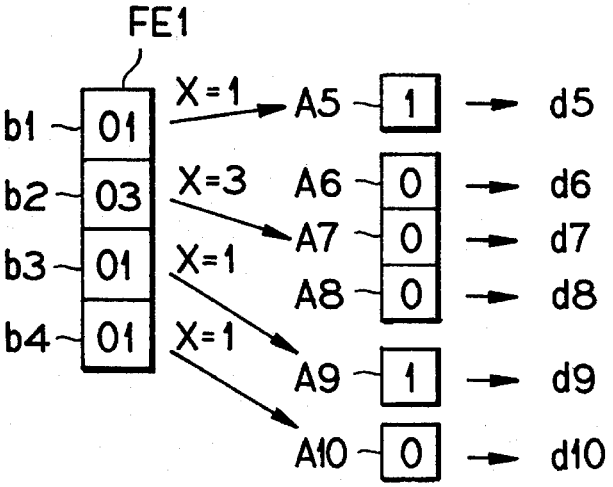

The conversion of the coded, variable image contents having the addresses B1 through B4 of the window FE1 into binary data is schematically shown in FIG. 3*d*. The variable image contents are also coded according to alternating runlength coding and are converted in the aforementioned way. It should be noted that the value of the run variable A immediately follows the value before the appearance of the control character, i.e., without a gap.

In a flow chart, FIG. 4 shows the program for generating binary data from the invariable image contents as well as the extraction of the control characters that indicate windows. This program is preferably executed before the activation of the printing mode, for example after a new franking image has been defined or after the existing franking image has been modified. For modifying the franking image, and editing program (not shown) is implemented wherein invariable and variable image contents are deposited in the main memory 26*c*. After the start of the program in method step 50, the invariable image contents belonging to a desired franking image, which, for example, are deposited in the main memory 26*c*, are selected and read out in the method step 52. After the loading of the coded data from the registers R1, R2 in method step 54, these printing data are checked for control characters. When the control character having the significance "end of image" appears (method step 56), the program is ended in step 58. Otherwise, a check is carried out in method step 60 to determine whether the control character having the significance "end of column" has appeared. When this applies, a branch is made to step 62, the run variable A is reset to its initial value A=1, and return is made to method step 54 and a switch to the next column ensues.

When the result in the testing step 60 is negative, then a check is carried out in the following step 64 to determine whether a control character is present that indicates a window in which variable image contents are to be offered. Given a negative result, the investigated, coded print data comprise invariable image contents and a branch is made to method step 66. The runlength coded datum is decoded there and the binary data are generated according to the explanations directed to FIGS. 3*a*–3*d*. Corresponding to the runlength X, the value A of the run variable is incremented and a branch is subsequently made to step 54.

Given the appearance of the control character "window", an advance to step 68 is made wherein the current value A' of the run variable A is deposited into the intermediate memory 26*b*. As mentioned, the control character contains a window number n, this being likewise stored. Since the length L, i.e. a number of printing dots or bytes of the respective window is known in advance, the run variable A is incremented by this amount and a return is made to step 54. After all coded printing data of the invariable image contents have been analyzed and decoded, the program is exited at step 58. The binary data acquired in the decoding are deposited in the pixel memory 26*a*.

The method steps that are incremented during printing are shown in the further flow chart in FIG. 5. After the start of the program in step 70, the control signal supplied from the electronic scale 28 is analyzed (method step 72) and the postage value to be printed is identified. Dependent on this postage value, data in the main memory 26*c* having variable image contents are accessed in method step 74, these image contents being allocated to this postage value. These data are offered as window printing data for the window FE1 (method step 74). The access ensues by indexed addressing, as shall be set forth later with reference to method step 94. Since the accessing involves the intermediate storage of the variable image contents, it is characterized as indirect memory addressing, and the aforementioned indexed addressing is thus indirect, indexed addressing.

In the following step 76, a run variable C is loaded, this being interpreted as the address at which the binary data of the invariable image contents are stored in the pixel memory 26*a*. This run variable C has a fixed relationship to the aforementioned run variable A that, as mentioned is interpreted as address for the binary data of a column. In method step 78, a check is made with reference to the run variable C to determine whether the franking image is completely printed. When this is the case, the printing program is ended in method step 80. Otherwise, a check is made in method step 82 to determine whether an end of column has been reached. When this is true, then all fifty binary information (bits) for the printing of a column are offered in the register 36 (FIG. 2), and this column can be printed in step 84 in a single printing event. Subsequently, the run variable C is set to the start of the next column in method step 86.

Given a negative outcome in step 82, a branch is made to method step 88. Here, the value of the run variable A is calculated from the current value of the run variable C, and a check is carried out in the following step 90 to determine whether the value A corresponds to the value A' that was previously calculated for this column in the program according to FIG. 4 (method step 68). If it is found in step 90 that the current value of the run variable A coincides with the value A', then the coded window printing data offered in the main memory 26*c* are decoded in step 74, are converted into binary data, are loaded into the register 36 by address on the basis of the run variable A, and are supplied to the thermotransfer printer head 12 in the step 84 at "end of column". In step 94, moreover, the run variable C is incremented by the length L of the window FE1. Further, an index variable I is incremented by 1. This serves the purpose of allowing the print data can be accessed by indexed addressing in the next column upon conversion of the coded window printing data. Subsequently, a branch is made to step 76. When all printing columns of the franking image have been printed, the printing is exited at "end of image" (step 78). If the current value of the run variable A does not coincide in step 90 with the value A', the run variable C is incremented by 1 in step 92, and a return to step 76 is made.

In the present example, only coded printing data for one window FE1 have been offered and converted into binary data. Of course, further sets of printing data for further windows, for example the windows FE2 and FE3 (FIG. 1), can be offered in an analogous way. Thus a number of sets of variable image contents can be stored in encoded form, respectively allocated to portions of a control signal, i.e., allocated to respective control characters. The current date, the time of day, a running printing number or a variable image part of a company logo can be printed in this or similar windows.

In a modification of the above exemplary embodiment of the invention, the invariable, binary data that are generated from the invariable runlength-coded image information by decoding are intermediately stored in a first area of the pixel memory 26*a*. The variable binary data acquired from the variable image contents are intermediately stored in a second area of the pixel memory 26*a*. When printing a column, the invariable and variable binary data are read out of the first end of the second area of the pixel memory 26*a* in the sequence described by the control characters and are entered into the registers 36 for the printing of a column. The combining of the invariable and variable image contents in this modification thus ensues in the register 36.

In another modification, the pixel memory 26*a* is divided into a plurality of memory areas corresponding to the invariable and variable image parts. The division is undertaken with reference to the control characters. The variable image contents can be stored in a memory area of the pixel memory 26*a* with permanently prescribed addresses corresponding to the pixels of the print image to be printed column-by-column. Given a modification of the binary data of a window, the memory area is accessed via these permanent addresses and the data thereof are modified.

In a third modification, the invariable image information can be stored in a read-only memory, for example, in the program memory 26*e*. In the decoding of the invariable image contents, this read-only memory 26*e* is accessed. The intermediate storing of the runlength-coded, invariable image information can then be eliminated. The corresponding memory area S1 of the main memory 26*c* can then be foregone.

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for controlling column-by-column printing of a franking image in a postage meter machine, said franking image having invariable image contents and variable image contents, said method comprising the steps of:

maintaining said invariable image contents and said variable image contents available in encoded form for incorporation into said franking impression;

converting said invariable image contents into invariable image binary data;

converting said variable image contents into variable image binary data separately from the conversion of said invariable image contents; and combining said invariable image binary data and said variable image binary data with each in a register only other during printing of said franking impression, and no earlier, to generate binary signals for controlling a column of print elements for printing said franking impression column-by-column with a single printhead, and supplying said binary signals from said register to said single printhead during printing of said franking impression.

2. A method as claimed in claim 1 wherein the step of converting said variable image contents into variable image binary data is further defined by converting said variable image contents for each column to be printed into variable image binary data for said column to be printed between the printing of successive columns.

3. A method as claimed in claim 1 wherein the step of converting said variable image contents into variable image binary data is further defined by converting said variable image contents into variable image binary data before printing of said franking impression, and maintaining said variable image binary data in a memory, and generating said binary signals from said variable image binary data during printing of said franking impression.

4. A method as claimed in claim 1 comprising the additional step of storing said invariable image contents and said variable image contents in coded form respectively in separate areas of a non-volatile memory.

5. A method as claimed in claim 1 comprising the additional steps of:

storing said invariable image contents in encoded form in a read only memory; and reading said invariable image contents in encoded form from said read only memory and decoding said invariable image contents immediately preceding printing of said franking image.

6. A method as claimed in claim 1 wherein the step of converting said invariable image contents into invariable image binary data is further defined by converting said invariable image contents into invariable image binary data before beginning printing of said franking image.

7. A method as claimed in claim 1 comprising the additional steps of:

sequentially printing a plurality of said columns with ascending numbering;

accessing said variable image information by indirect, indexed memory addressing; and converting said variable image contents into variable image binary data dependent on the number of the column to be printed.

8. A method as claimed in claim 1 comprising the additional steps of:

maintaining a plurality of sets of invariable image contents in encoded form; and optionally accessing said sets.

9. A method as claimed in claim 1 comprising the additional step of runlength coding said variable image contents and said invariable image contents.

10. A method as claimed in claim 1 comprising the additional step of storing a plurality of sets of variable image contents in encoded form, respectively allocated to portions of a control signal.

11. A method as claimed in claim 10 comprising the additional step of providing said control signal in a form containing portions including a postage value to be printed, a date, a time of day, a serial number of a postage meter machine, a running print number and a variable image of a company logo.

12. A method as claimed in claim 10 comprising the additional step of accessing said variable image contents by indirect memory addressing.

13. A method as claimed in claim 1 comprising the additional step of respectively identifying said variable and invariable image contents in encoded form with a control character identifying the image contents as variable or invariable.

14. A method as claimed in claim 13 comprising the additional step of sorting image contents in encoded form into variable and invariable image contents dependent on said control characters.

15. A method as claimed in claim 14 wherein said image information in encoded form is in the form of a character set, and comprising the additional step of employing control characters having a value not contained in said character set.

16. A method as claimed in claim 15 comprising the additional steps of arranging invariable image contents, to be respectively printed in successive columns, in a sequence corresponding to column-by-column printing, and inserting said control characters between the respective invariable image contents for each column.

17. A method as claimed in claim 16 comprising the additional steps of:

sequentially converting said invariable image contents into address-oriented invariable image binary data column-by-column from said sequence;

investigating the invariable image binary data for each column for the presence of control characters;

printing said franking image with a plurality of printing elements and assigning an address to each printer element;

upon the appearance of a control character as a result of the investigation for control characters, storing the address of the associated invariable image binary data as a window address;

before printing a column, offering the invariable image binary data for printing of that column to printer elements sequentially addressed in a printing program;

when reaching said window address in said printing program, branching into a window program;

in said window program, converting said variable image contents into variable image binary data for supply to corresponding addressed printer elements; and after completing said window program, returning to said printing program.

18. A method as claimed in claim 17 comprising the additional step of:

storing a plurality of window programs each having a start address stored as said window address dependent on a control character.

* * * * *